US006768485B2

(12) United States Patent
Awamoto et al.

(10) Patent No.: US 6,768,485 B2
(45) Date of Patent: Jul. 27, 2004

(54) COLOR IMAGE DISPLAY DEVICE

(75) Inventors: Kenji Awamoto, Kawasaki (JP); Katsuya Irie, Kawasaki (JP); Kunio Takayama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 337 days.

(21) Appl. No.: 10/077,766

(22) Filed: Feb. 20, 2002

(65) Prior Publication Data

US 2003/0067426 A1 Apr. 10, 2003

(30) Foreign Application Priority Data

Oct. 10, 2001 (JP) ..... 2001-312233

(51) Int. Cl.[7] ..... E06K 15/02

(52) U.S. Cl. ..... 345/204; 345/501; 345/531; 345/589; 345/593; 345/601; 345/612; 345/619; 345/625; 345/634; 358/501; 358/530; 358/401; 358/448; 382/162

(58) Field of Search ..... 345/204, 501, 345/531, 589, 593, 601, 612, 619, 625, 634; 358/501, 530, 401, 448; 382/162

(56) References Cited

U.S. PATENT DOCUMENTS 5,481,377 A * 1/1996 Udagawa et al. ..... 358/501
5,825,128 A * 10/1998 Betsui et al. ..... 313/582
6,381,030 B1 * 4/2002 Udagawa et al. ..... 358/1.14

* cited by examiner

*Primary Examiner*—Bipin Shalwala
*Assistant Examiner*—Vincent E. Kovalick
(74) *Attorney, Agent, or Firm*—Staas & Halsey LLP

(57) ABSTRACT

An image display device is provided, which can secure a predetermined display quality regardless of a type of an input image. The color image display device comprises a display device having a delta arrangement screen, a driving circuit, an image decision circuit for deciding which of plural predetermined types an input image is, a memory circuit for memorizing temporarily at least a part of input image data for one frame, an operation circuit for performing an operation process having preset contents in accordance with image data for plural pixels including image data read out of the memory circuit, and an operation control circuit for switching the contents of the operation process in the operation circuit in response to the output of the image decision circuit.

9 Claims, 16 Drawing Sheets

INPUT INTERFACE
60
S10
S20
S30
D11
S21
DATA CONVERSION CIRCUIT
70
D12
S22
DRIVING CIRCUIT
80
SUBFRAME PROCESSING PORTION
82
FRAME MEMORY
Dsf
POWER SOURCE FOR DISCHARGE
83
88
86
84
DRIVER CONTROLLER
81
A
Y
X
1
100

COLOR IMAGE DISPLAY DEVICE

BACKGROUND OF THE INVENTION

1. Field of the Invention

The present invention relates to a color image display device, and is particularly suitable for a display that uses a plasma display panel (PDP).

Recently, a high quality output image of a television set and a computer has been progressed, and a display device that can provide a display with high quality regardless of a type of the image such as a nature image or a character image.

2. Description of the Prior Art

As a display device having a large screen, a surface discharge format AC type PDP is commercialized. The surface discharge format means the format in which first and second display electrodes that become anodes and cathodes in display discharge for securing luminance are arranged in parallel on a front or a back substrate. A "three-electrode structure" in which an address electrode is arranged so as to cross a pair of display electrodes is common as an electrode matrix structure of the surface discharge format PDP. One of the display electrodes (a second display electrode) is used as a scan electrode for selecting a display line, and address discharge is generated between the scan electrode and the address electrode, so that wall charge is controlled in accordance with contents of a display as an addressing step.

U.S. Pat. No. 5,825,128 has proposed a modified stripe partition structure of the three-electrode surface discharge type PDP for preventing discharge interference in the column direction (usually in the vertical direction) of the screen by meandering plural band-like partitions regularly that divide a discharge space in the row direction (i.e., the display line direction that is usually the horizontal direction) of the screen. Two neighboring partitions define a column space in which wide portions and narrow portions are arranged alternately. The position of the wide portion is shifted between neighboring columns, and a cell is formed in each of the wide portions. Red, green and blue fluorescent materials for a color display are arranged so that one color is disposed at each column space and a light emission color is different between neighboring column spaces. The arrangement form of the three colors is what is commonly called delta tri-color arrangement (or simply delta arrangement). The delta arrangement has a cell width larger than one third of a pixel pitch in the row direction. Therefore, compared with a square arrangement, the delta arrangement has a larger aperture ratio and realizes a higher luminance display. It is not necessary that the horizontal direction is the row direction. The vertical direction can be the row direction and the horizontal direction can be the column direction.

Conventionally, in a color image display using the delta arrangement PDP, each display line consists of cells each of which is selected fixedly from a cell column along an address electrode.

There was a problem that the following two phenomena cause an unnatural display.

(1) Since the positions of the neighboring cells are shifted in the vertical direction, a line in the horizontal direction is displayed in zigzag.

(2) A distance between the lighted cells becomes uneven when displaying a line inclined in the horizontal direction and in the vertical direction.

SUMMARY OF THE INVENTION

An object of the present invention is to provide an image display device that can secure predetermined display quality regardless of a type of an input image. Another object is to realize a pseudo interlace display, so as to improve resolution in the column direction.

A color image display device according to the present invention comprises a display device having a cell arrangement structure in which cell positions in the column direction are shifted from each other between neighboring cell columns among cell columns having the same lighting color and an image decision circuit for deciding which of plural predetermined types an input image is, and switches a form of the process for converting the image data into display data corresponding to the cell arrangement of the display screen in response to the input of the image data in accordance with the image decision result. An operation circuit is provided as data conversion process means. The cells are divided into groups considering the cell arrangement not uniformly to all cells of the display screen, and an appropriate operation such as a convolution process is performed for each group in different contents, or is performed only for some groups. The result of the operation is made display data, so that a phenomenon that a line looks zigzag can be reduced, or a pseudo interlace display can be realized. The operation includes a data process for selecting data of one or the other of neighboring lines in the input image as the display data.

DESCRIPTION OF THE PREFERRED EMBODIMENTS

Hereinafter, the present invention will be explained more in detail with reference to embodiments and drawings.

Figure 1:
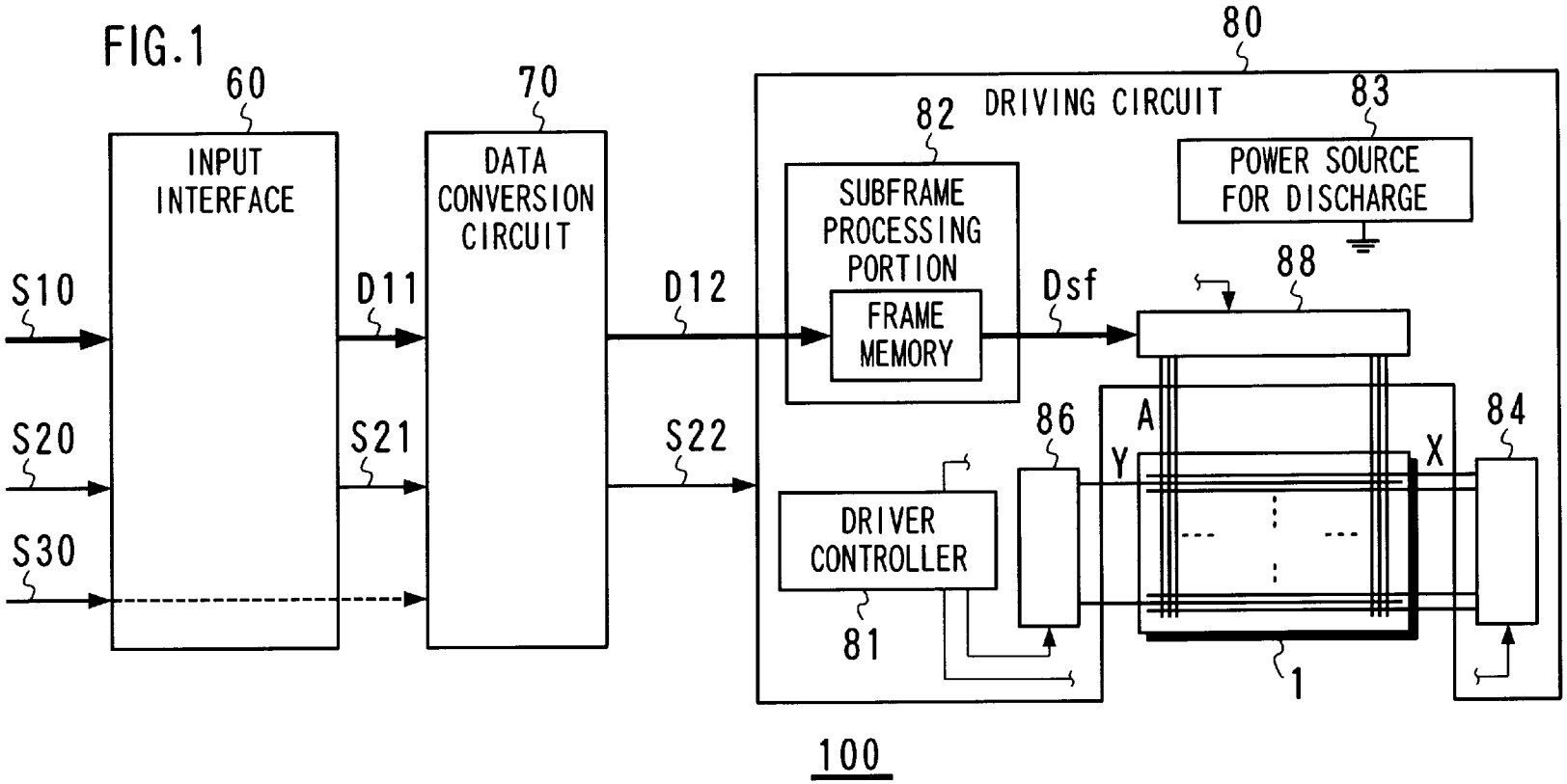
FIG. 1 is a block diagram of a display device according to the present invention.

FIG. 1 is a block diagram of a display device according to the present invention. The display device 100 comprises a three-electrode surface discharge format AC type PDP 1 having a display screen including m×n cells, a driving circuit 80 for supplying an electric power for light emission to a cell that is a display element, an input interface 60 that receives a signal from an image output device and a data conversion circuit 70 that is unique to the present invention. The display device 100 is used for a wall-hung television set or a monitor of a computer system.

In the PDP 1, display electrodes X and Y for generating display discharge are arranged on one substrate, and address electrodes A are arranged so as to cross the display electrodes. The total n+1 display electrodes X and Y extend in the horizontal direction of the display screen. Neighboring display electrodes X and Y constitute an electrode pair for generating surface discharge, and define a display line (a row) in the screen. The display electrode except the both ends of the arrangement works for two display lines (an odd row and an even row), while the display electrode at each end works for one display line. The display electrode Y is used as a scan electrode for selecting a line (a row) in addressing.

The driving circuit 80 includes a driver controller 81, a subframe processing portion 82, a power source for discharge 83, an X-driver 84, a Y-driver 86 and an address driver 88. The driving circuit 80 is supplied with frame data D12 and a synchronizing signal S22 from the data conversion circuit 70. The subframe processing portion 82 converts the frame data D12 from the previous portion into subframe data Dsf for a gradation display. The subframe data Dsf indicate whether a cell is lighted or not in each of plural subframes (a binary image) representing a frame (a multi-valued image), more specifically whether address discharge is necessary or not. The X-driver 84 is means for setting a potential of a display electrode X. The Y-driver 86 includes a scan circuit and is constituted so that potential of the display electrodes Y can be controlled individually or as a single unit. The scan circuit is means for setting the potential for selecting a display line in the addressing. The address driver 88 controls a potential of total m address electrodes A in accordance with the subframe data Dsf.

Figure 2:
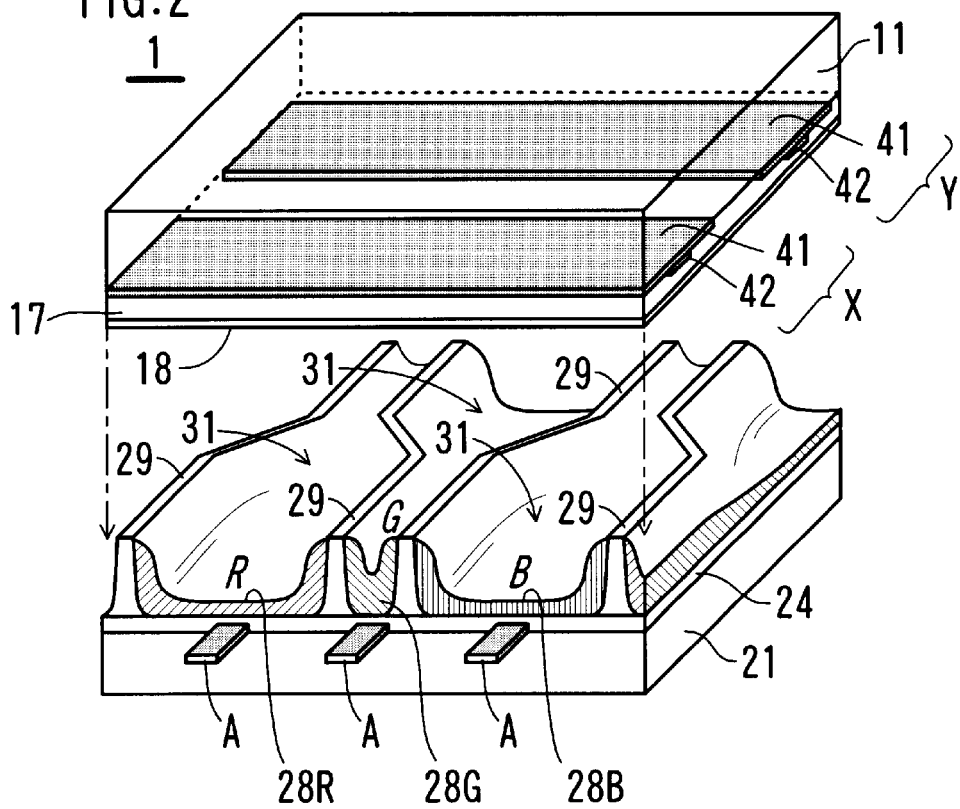
FIG. 2 is a diagram showing a cell structure of a PDP according to the present invention.
Figure 3:
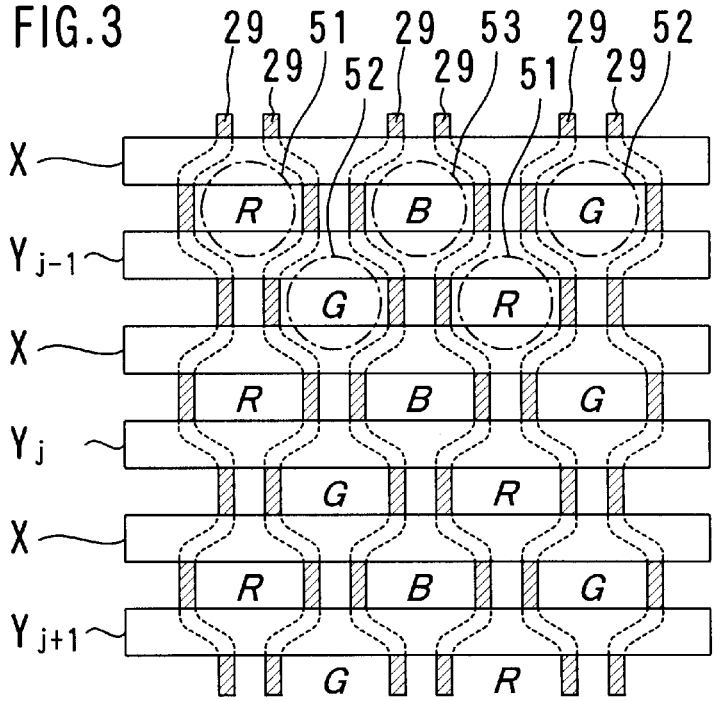
FIG. 3 is a diagram showing a partition pattern.

FIG. 2 is a diagram showing a cell structure of a PDP according to the present invention. FIG. 3 is a diagram showing a partition pattern. In FIG. 3, the reference character "Y" of the display electrode Y is followed with a suffix indicating the arrangement order.

The PDP 1 comprises a pair of substrate structures (each structure has a substrate on which cell elements are arranged). In each cell of the display screen, a pair of display electrodes X and Y and an address electrode A cross each other. The display electrodes X and Y are arranged on the inner surface of the front glass substrate 11, and each of the display electrodes X and Y includes a transparent conductive film 41 and a metal film (a bus electrode) 42. The display electrodes X and Y are covered with a dielectric layer 17, which is coated with a protection film 18 made of magnesia (MgO). The address electrodes A are arranged on the inner surface of the back glass substrate 21 and are covered with a dielectric layer 24. On the dielectric layer 24, meandering band-like partitions 29 having the height of approximately 150 microns are arranged so that one partition 29 is disposed between address electrodes A. The partitions 29 divide a discharge space along the horizontal direction at a constant pitch. A column space 31, which is a discharge space between neighboring partitions, is continuous over all display lines. The inner surface of the back side including the over surface of the address electrodes A and the side faces of the partitions 29 is covered with red, green and blue fluorescent material layers 28R, 28G and 28B for a color display. The italic letters (R, G and B) in FIG. 3 indicate light emission colors of the fluorescent materials. The fluorescent material layers 28R, 28G and 28B are excited locally by ultraviolet rays emitted by discharge gas so as to emit light.

As shown in FIG. 3, every partition 29 meanders so as to form the column spaces in which the wide portions and the narrow portions are arranged alternately. Between neighboring column spaces, the positions of the wide portions in the column direction are shifted to each other by a half pitch of the cell in the column direction. The cell is formed in each of the wide portions, and cells 51, 52 and 53 of one display line are indicated by alternate long and short dash lines as types in FIG. 3. The display line is a set of cells to be lighted when displaying a line having the minimum width (the one-pixel width) in the horizontal direction.

Figure 4:
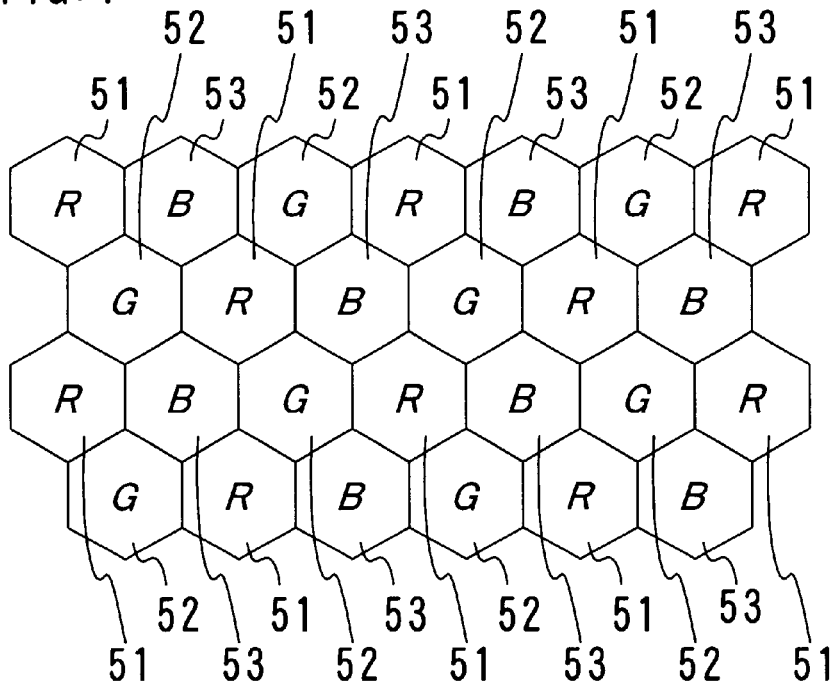
FIG. 4 is a schematic diagram of cell arrangement.
Figure 5:
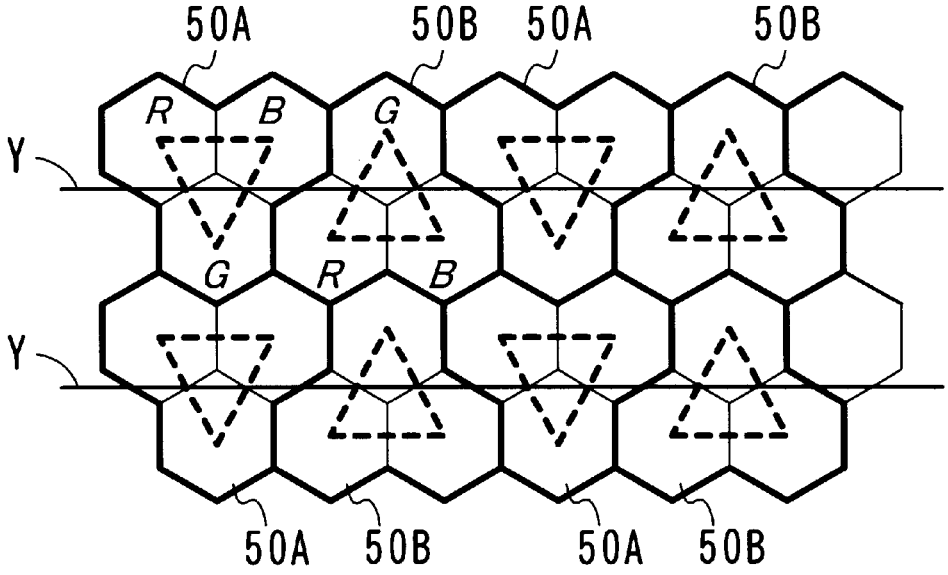
FIG. 5 is a diagram showing a pixel structure of a color display.

FIG. 4 is a schematic diagram of cell arrangement. FIG. 5 is a diagram showing a pixel structure of a color display.

In FIG. 4, the light emission color of the cell 51 is red (R), the light emission color of the cell 52 is green (G), and the light emission color of the cell 53 is blue (B). In the PDP 1 as shown in FIG. 4, cells in a cell column that is a set of cells corresponding to a column space, i.e., cells aligned in the vertical direction have the same color. The color of the cells are different from each other between the neighboring cell columns, and the position of the cells in the column direction are shifted from each other between the neighboring cell columns in a set of cell columns having the same color (e.g., a set of red cells 51).

As shown in FIG. 5, the display screen is divided in the vertical direction by every two cells and in the horizontal direction by every three cells, so that a set of three cells is made a pixel (or dot) 50A or 50B. One dot 50A of two dots 50A and 50B neighboring in the horizontal direction is a cell group arranged in an inverted triangle, while the other dot 50B is a cell group arranged in a regular triangle. In the dot 50A, the centers of the R cell and the B cell are located at the upper side of the display electrode Y as the scan electrode, and the center of the G cell is located at the lower side. On the contrary in the dot 50B, with respect to the display electrode Y, the center of the G cell is located at the upper side, and the centers of the R cell and the B cell are located at the lower side. Here, the R cell in the dot 50A, the B cell in the dot 50A and the G cell in the dot 50B are referred to as "upper shit cells", while the G cell in the dot 50A, the R cell in the dot 50B and the B cell in the dot 50B are referred to as "lower shift cells".

Figure 6:
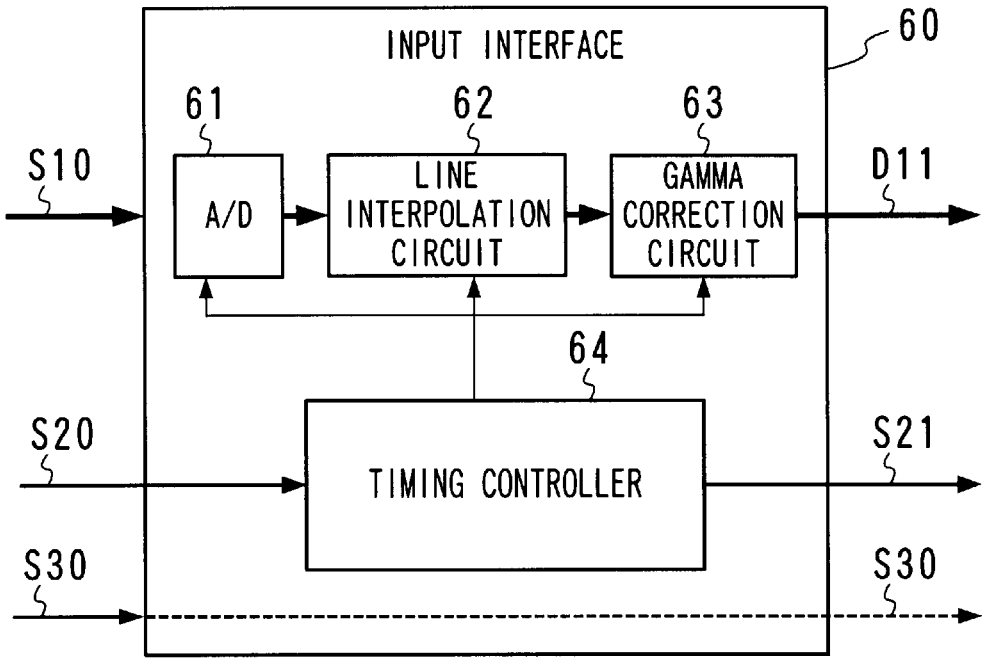
FIG. 6 is a block diagram of an input interface.

FIG. 6 is a block diagram of an input interface.

The input interface 60 includes an analog to digital converter 61, a line interpolation circuit 62, a gamma correction circuit 63 and a timing controller 64. Since the display device 100 can be connected to various image signal sources, there are various sizes (a dot number multiplied by a line number) of images that are entered into the input interface 60. In analog to digital conversion, timing of clock is adjusted so that the number of dots in the horizontal direction is identical to the number of dots of the display panel. The line interpolation circuit 62 switches the size in the vertical direction. The line interpolation circuit 62 delays the data by one line period using a line memory, and performs interpolation operation between cells in the vertical direction in accordance with the data of neighboring display lines. For example, new data of one line are generated from the average value of data between two lines in the vertical direction and are inserted between the original two lines, so that the number of lines can be doubled. In addition, when outputting the generated data of one line instead of the two lines, the number of lines can be reduced to a half. The gamma correction circuit 63 adjusts the data value so as to match the luminance reproduction characteristics of the PDP 1. The timing controller 64 makes synchronization of the image signal process using a synchronizing signal S20 given by an external device and outputs a synchronizing signal S21 that is necessary for the subsequent operation.

Figure 7:
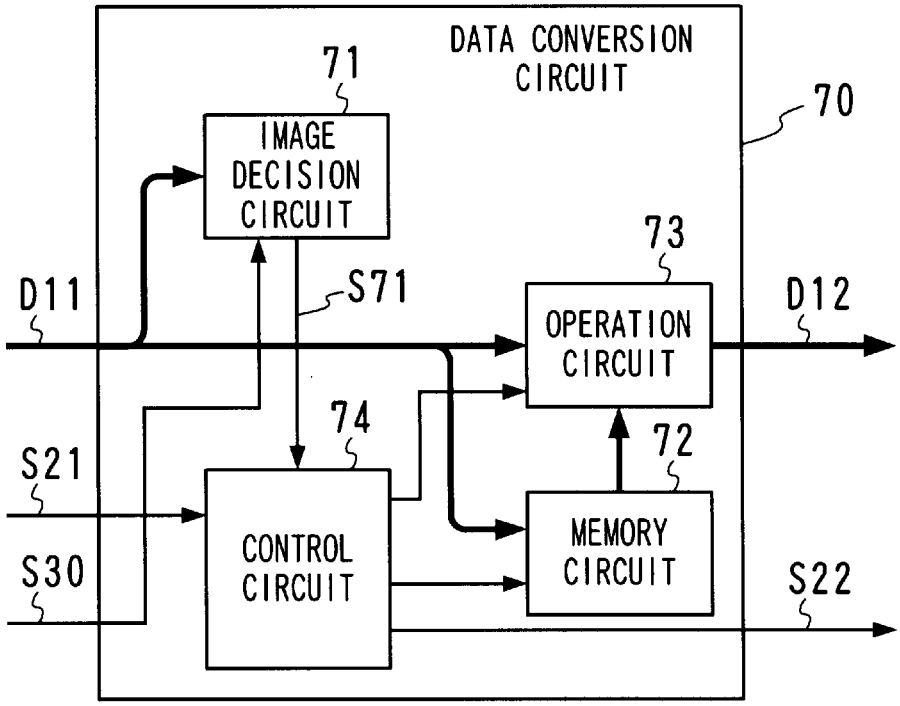
FIG. 7 is a block diagram of a data conversion circuit.

FIG. 7 is a block diagram of the data conversion circuit.

The data conversion circuit 70 includes an image decision circuit 71, a memory circuit 72, an operation circuit 73 and a control circuit 74. The data conversion circuit 70 is supplied with image data D11, the synchronizing signal S21 and a user selection signal S30. The user selection signal S30 indicates an item selected by the user, which includes switching of input between a TV image and a computer image and desired image quality (the extent of sharpness).

The image decision circuit 71 decides an input image size, a type of the image format (a standard TV picture, a high definition TV picture, a VGA computer image, an XGA computer image or others) and a type of image information (a still image, a moving image, a nature image, a graphic image, a character image or others). However, concerning the size and the format, it is possible to receive the decision result from the input interface 60. A high resolution display utilizing a pseudo interlace conversion is useful for a high definition TV picture. A zigzag reducing process is useful for an accurate still image such as CAD drawing. Among computer images, picture images and line drawing images are different in desired image quality, so it is desirable to perform a process suitable to the image type. It can be determined in advance what type of process to be added to the image decision result by evaluating various displayed images objectively.

Figure 8:
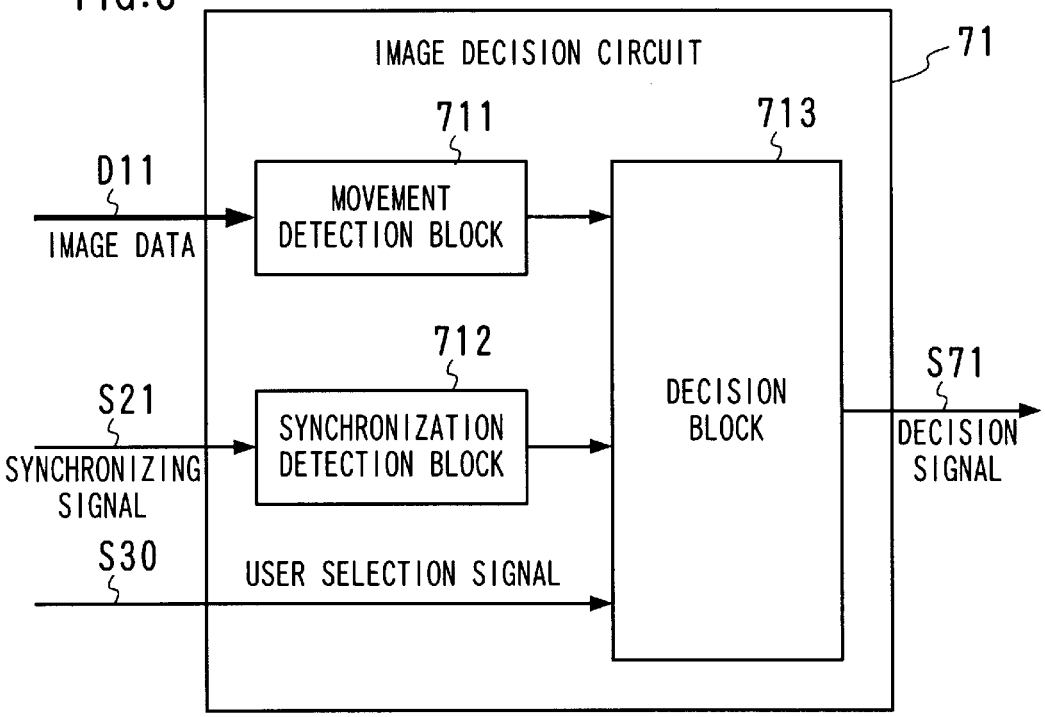
FIG. 8 is a block diagram of an image decision circuit.

FIG. 8 is a block diagram of the image decision circuit.

The user selection signal S30 is entered into a decision block 713. If the user designates an input image source specifically, the designated contents are outputted as a decision signal S71. In order to decide the input image automatically, a movement detection block 711 and a synchronization detection block 712 are provided. The movement detection block 711 decides whether the input image is information containing mainly still images such as characters and photographs or information containing mainly moving pictures such as a TV program. The movement detection block 711 is not necessarily required to detect a precise movement vector but can be a simple circuit that can detect roughly. The synchronization detection block 712 decides whether the input image format is standardized one such as 1080i (an HDTV signal) or an XGA or not. From the decision of the standard, the image size as well as whether interlace scanning is performed or not becomes clear. The outputs of the movement detection block 711 and the synchronization detection block 712 are integrated as a decision signal S71 in the decision block 713.

Hereinafter, the function of the data conversion circuit 70 will be explained in detail.

Figure 9A:
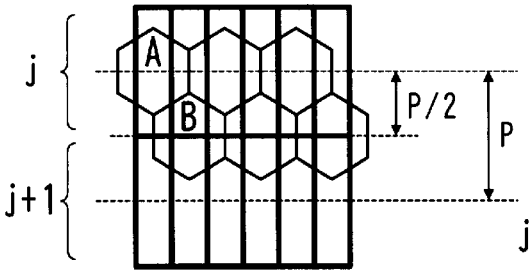
FIGS. 9A and 9B are diagrams for explaining a format conversion from a square arrangement into a delta arrangement.
Figure 9B:
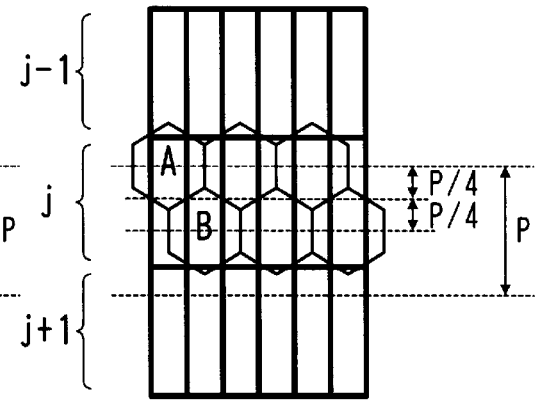

FIGS. 9A and 9B are diagrams for explaining a format conversion from a square arrangement into a delta arrangement. In general, an image source is made on the precondition that it is displayed on a screen having a square arrangement made of a set of red, green and blue cells and in which the shape of a dot is square. The screen of this precondition is called a virtual screen. In the display device 100 having a display screen of the delta arrangement (hereinafter, it is referred to as a real screen), the control for lighting a predetermined cell is performed considering the cell position relationship between the virtual screen and the real screen. In the delta arrangement screen, the cell center is shifted in the vertical direction for each cell along the horizontal direction and is made of upper shift cells and lower shift cells as mentioned above. The data conversion circuit 70 performs the format conversion from the virtual screen into the delta arrangement screen.

FIG. 9A shows a conversion process for making the upper shift cell A match the cell center of the virtual screen (it is possible to make the lower shift cell B match). FIG. 9B shows a conversion process for making the center of the cell pair in the vertical direction including the upper shift cell A and the lower shift cell B neighboring to each other match the center of the virtual screen cell in the vertical direction. The present invention can be embodied in two forms: one of the two processes is performed in the first form, while the both processes are performed by switching in the second form.

In FIG. 9A, since the upper shift cell A is located on the j-th display line in the virtual screen, the data of the j-th display line in the virtual screen are distributed without change. Since the lower shift cell is over the j-th display line and the (j+1)th display line, an average value of data of the j-th display line and data of the (j+1)th display line are distributed. Since the process is not performed for the upper shift cell A substantially and is performed only for the lower shift cell B, the operation becomes an intermittent operation that is performed for every other cell.

In FIG. 9B, since the upper shift cell A is located over the (j−1)th display line and the j-th display line, a weighted average of data of these two display lines is calculated and is distributed. In the same way, concerning the lower shift cell B, a weighted average of data of the j-th display line and the (j+1)th display line is calculated and is distributed. Since the process is performed for both the upper shift cell A and the lower shift cell B, the operation becomes a continuous operation.

Figure 10:
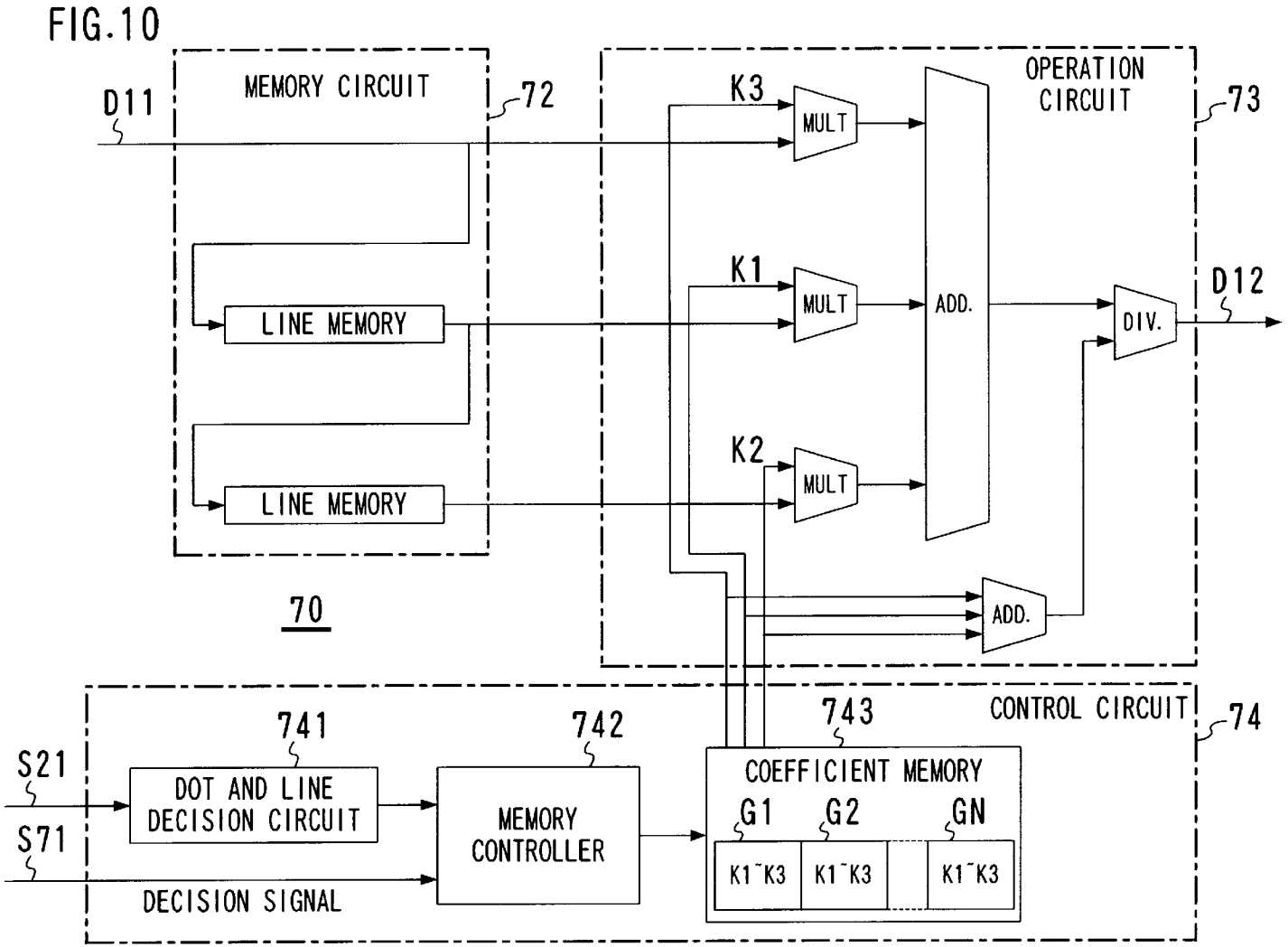
FIG. 10 is a block diagram showing a first example of a data conversion circuit.

FIG. 10 is a block diagram showing a first example of a data conversion circuit. In FIG. 10, the image decision circuit 71 shown in FIG. 7 is omitted and other portions are drawn in detail. In FIG. 10, "MULT" denotes a multiplier, "ADD." denotes an adder, and "DIV." denotes a divider. The memory circuit 72 includes a line memory that memorizes input data of two display lines. The memory circuit 72 outputs the real time image data D11 that are entered in the dot arrangement order, the image data D11 delayed by the transmission time for one line and the image data D11 delayed by the transmission time for two lines. Thus, the dot data of total three lines at the same position in the horizontal direction are given to the operation circuit 73 simultaneously. In the operation circuit 73, the multiplier performs multiplication of the input data by coefficients K1, K2 and K3. The coefficients K1, K2 and K3 are one set of the plural coefficient sets G1, G2, . . . , GN that are previously memorized in a coefficient memory 743 of the control circuit 74. In the control circuit 74, a dot and line decision circuit 741 decides the line position and the dot position of the data in response to the data input into the operation circuit 73. In response to the output of the dot and line decision circuit 741 and the decision signal S71 of the former stage, a memory controller 742 read a set of coefficients K1, K2 and K3 out of the coefficient memory 743. The coefficient that is given to the multiplier is switched every other dot in the case of the above-mentioned intermittent operation, while the coefficient is switched for each dot in the case of the continuous operation.

Figure 11:
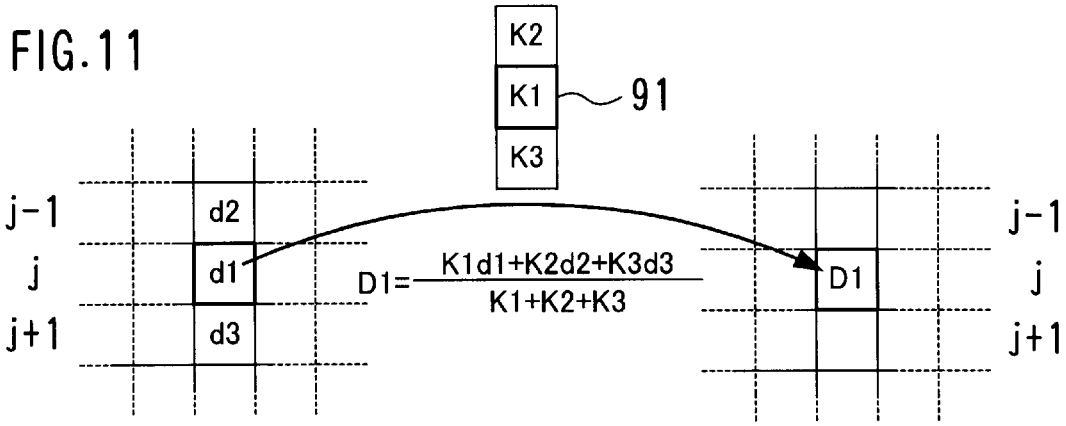
FIG. 11 is a diagram showing a concept of a convolution process in a first example of an operation circuit.

FIG. 11 is a diagram showing a concept of a convolution process in a first step of the operation circuit.

The above-mentioned circuit shown in FIG. 10 has a function of delaying data by two lines, so that the operation process can be performed for three dots neighboring in the vertical direction and having the same dot position in the horizontal direction concerning the (j−1)th display line, j-th display line and (j+1)th display line. Namely, luminance values d1–d3 of three dots including the noted dot, the upper adjacent dot and the lower adjacent dot are read, and the operation matrix 91 defining the coefficients K1–K9 is applied for each dot position so that a display luminance value D1 of the noted dot is calculated. The operational equation is $D=(K1d1+K2d2+K3d3)/(K1+K2+K3)$. By selecting the coefficients K1–K3 as appropriate, various lighting pattern can be obtained. It is important to change the coefficient as appropriate in accordance with the shift state of the noted dot (the upper shift cell or the lower shift cell) when applying the process. Without limiting to the structure shown in FIG. 12 in which when the coefficients K1, K2 and K3 are given to the multiplier, the sum of the coefficients K1, K2 and K3 (K1+K2+K3) is determined by the adder and is given to the divider, it is possible to determine the sum of the coefficient for all coefficient sets in advance and to memorize it in the coefficient memory 743, so that the coefficient set and the sum of the coefficients are read out and are given to the operation circuit 73.

The image data to be entered include R data, G data and B data for one dot. The data for one dot are transmitted in series in the order of R, G and B, and one operation circuit can process sequentially. In this case, the circuit shown in FIG. 12 can be only one. In addition, it is possible to provide three circuits shown in FIG. 12 for processing the R data, G data and B data in parallel. In this case, the dot and line decision circuit 741, the memory controller 742 and the coefficient memory 743 can be shared by the three circuits, having a structure that can perform the three different operation process at the same time. If the three circuits are provided, the operation process speed can be slower than in the case of one circuit.

Next, concrete values of the coefficients K1, K2 and K3 and their effects will be explained.

Figure 12:
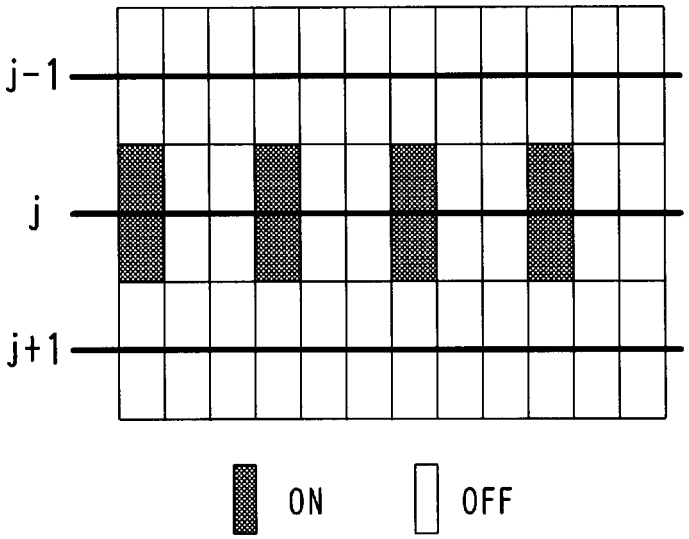
FIG. 12 is a diagram showing a lighting pattern of a single color line display in a square arrangement screen.
Figure 13A:
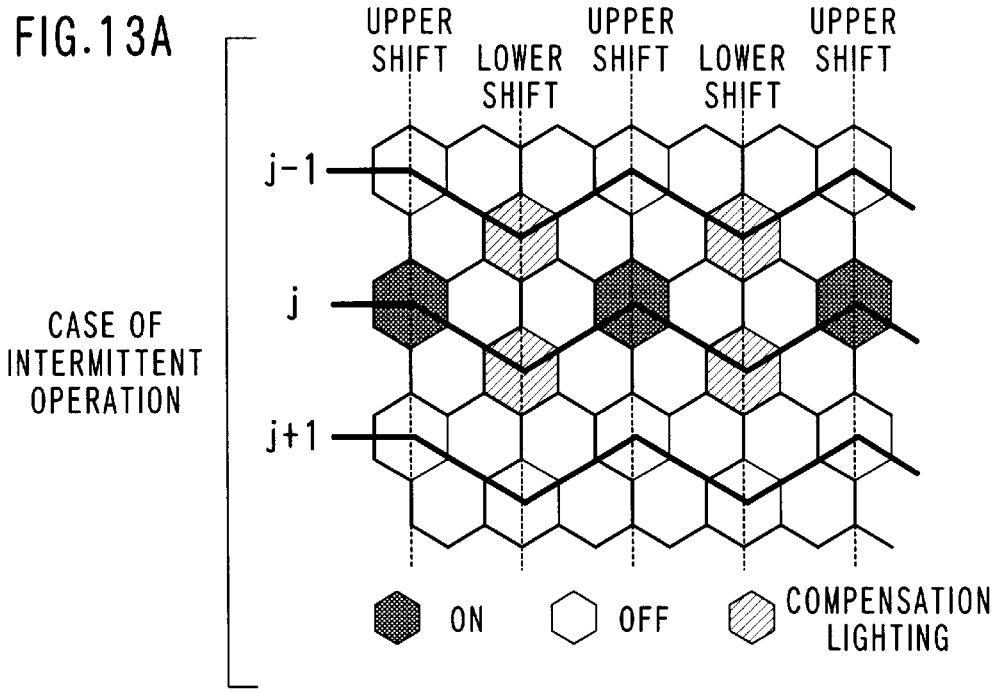
FIGS. 13A and 13B are diagrams showing a lighting pattern of a single color line display in a delta arrangement screen.
Figure 13B:
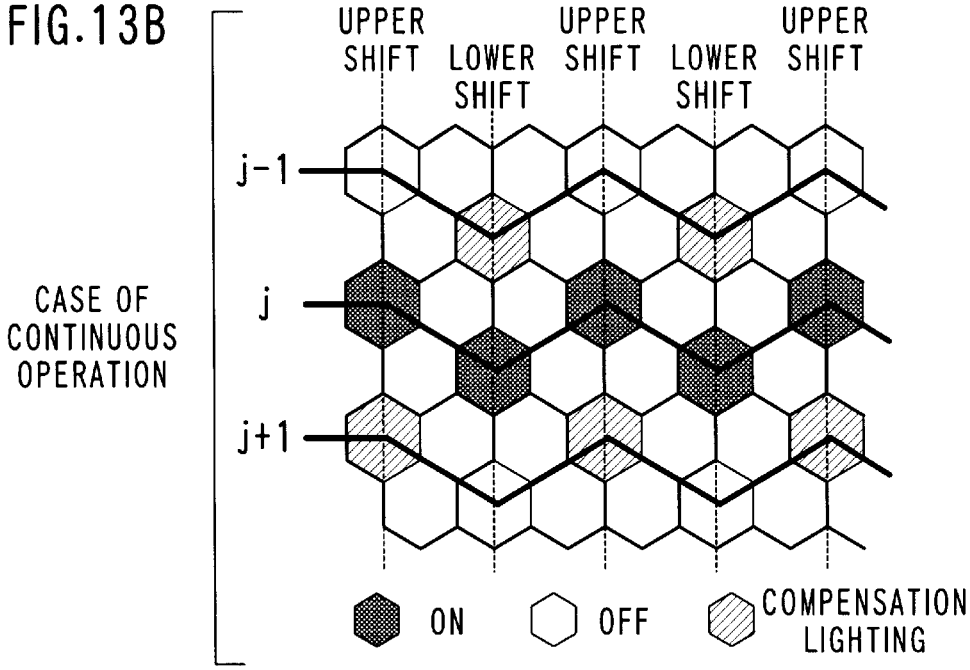

FIG. 12 is a diagram showing a lighting pattern of a single color line display in the square arrangement screen. FIGS. 13A and 13B are diagrams showing a lighting pattern of a single color line display in the delta arrangement screen.

First, the case is considered where the convolution operation process of the intermittent operation is performed. The input image includes a linear line in the horizontal direction as shown in FIG. 12, which is displayed by lighting only cells of one color (e.g., red) on the j-th display line in the virtual screen.

The upper shift cell is remained in the non-process, and the lower shift cell is used for calculating an average value with the lower adjacent cell. As the coefficients (K2, K1 and K3), (0, 1, 0) is applied to the upper shift cell, and (0, 1, 1) is applied to the lower shift cell. As shown in FIG. 5, since R and B cells are the upper shift cells in the first dot, the coefficient set (0, 1, 0) is applied to them. Since the G cell is the lower shift, the coefficient set (0, 1, 1) is applied to it. In the second dot, R and B cells are lower shift cells, and G cell is the upper shift cell. Therefore, these two coefficient sets are exchanged. Furthermore, the explanation will be done in the display line order. The data of the j-th display line are memorized in the display line memory when inputting the data of the j-th display line. Next, when entering data of the (j+1)th display line, the operation result on the basis of the data of the j-th display line and the data of the (j+1)th display line are outputted as data of the j-th display line, and simultaneously the data of the (j+1)th display line are memorized in the display line memory. With respect to the line timing of the input data, the line timing of the output data is delayed by one display line. In the display by this operation, the lighting luminance becomes a half, and simultaneously the upper side cell is lighted by the remained half luminance as compensation in the portion where the lower shift cell is lighted as shown in FIG. 13A. Thus, the barycenter position of the two lower shift lighted cells in the vertical direction is identical to the position of the upper shift cell in the vertical direction. As a result, the "zigzag" of the horizontal line in the display is reduced. The similar effect can be obtained in the display of the inclined line.

Next, the case is considered where the convolution operation process of the continuous operation is performed. As an example of the coefficient set (K2, K1, K3), (1, 3, 0) is applied to the upper shift cell, and (0, 3, 1) is applied to the lower shift cell. In this case, the input luminance data of the (j−1)th display line are added a bit to the luminance data of the upper shift cell of the j-th display line, while the input luminance data of the (j+1)th display line are added a bit to the luminance data of the lower shift cell. In addition, the explanation will be done in the display line order. When inputting the data of the (j−1)th display line, the data of the (j−1)th display line are memorized in the first display line memory. Next, when inputting the data of the j-th display line, the data of the (j−1)th display line are transferred to the second line memory, and the data of the (j−1)th display line are memorized in the first line memory. Next, when inputting the data of the (j+1)th display line, the data of the (j−1)th display line, the j-th display line and the (j+1)th display line are used for the operation, and the result of the operation is outputted as the j-th display line data. At the same time, the j-th display line data are transferred to the second line memory, and the data of the (j+1)th display line are memorized in the first line memory. With respect to the line timing of the input data, the line timing of the output data is delayed by one display line. In the display by this operation, the cells at the upper and the lower sides of each of the upper shift cell and the lower shift cell, which are lighted as shown in FIG. 13B, are lighted by distributing a part of the original lighted cell luminance in compensating way. As a result, the zigzag in the display of the horizontal line is reduced. The similar effect can be obtained in the display of an inclined line. In the example, the ratio of the coefficients K2 and K3 to the coefficient K1 is set to 3:1. However, the compensation lighting luminance can be controlled by setting the other ratio so that the characteristics of the image correction can be adjusted. When the ratio of the coefficients K2 and K3 is 0 (zero), it is not processed. When the ratio is above zero, the zigzag correction effect is obtained. As the value is increased, the effect of reducing the zigzag increases. However, if it becomes too large, the width of the display line becomes too thick, resulting in reduction of the vertical resolution. If the ratio is 1:1, it looks like the thickness of the line is doubled. Therefore, it is desirable that the coefficient is selected so that the ratio of the coefficients K2 and K3 are larger than zero and smaller than one when the coefficient K1 is one.

Figure 14:
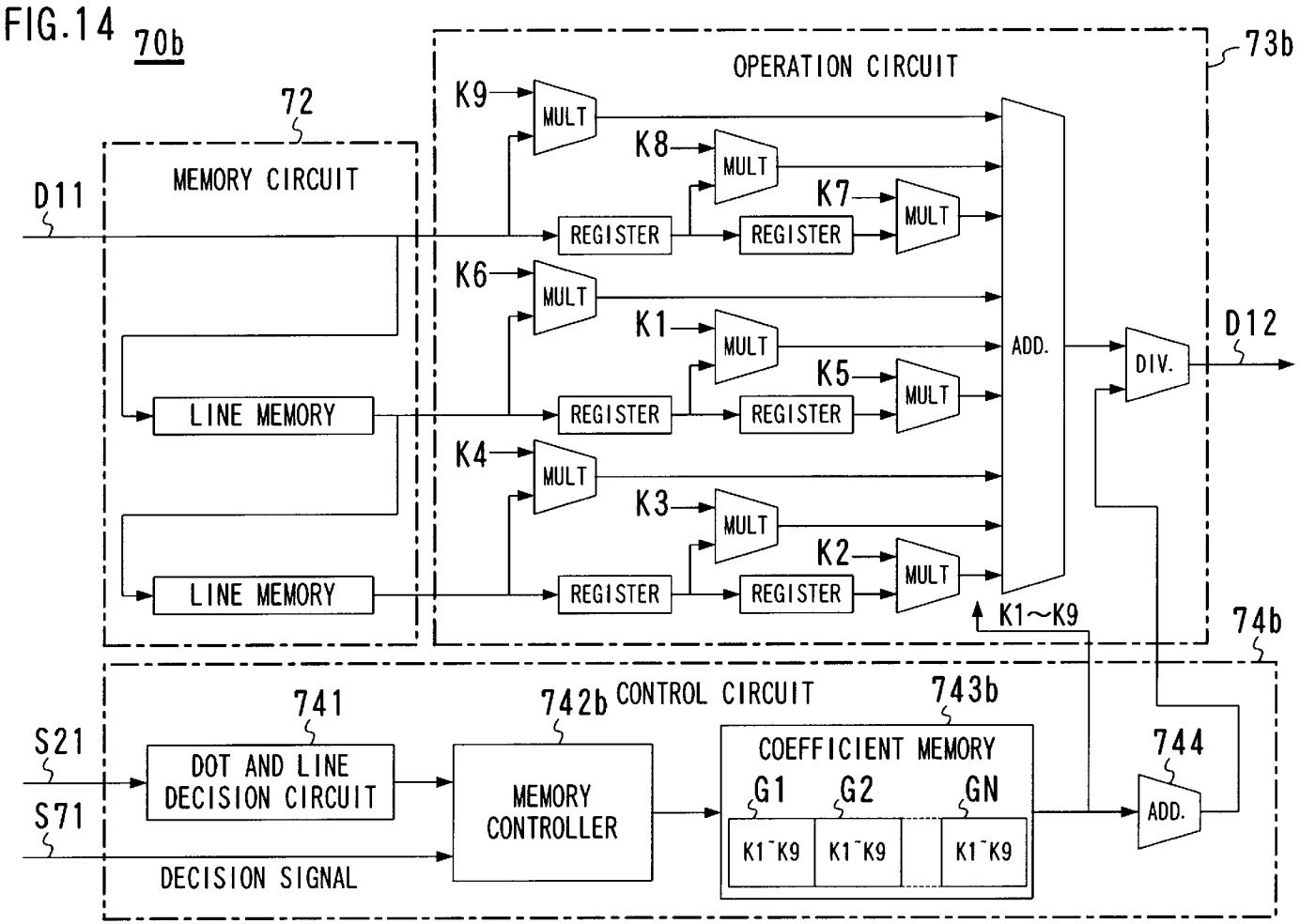
FIG. 14 is a block diagram showing a second example of the data conversion circuit.
Figure 15:
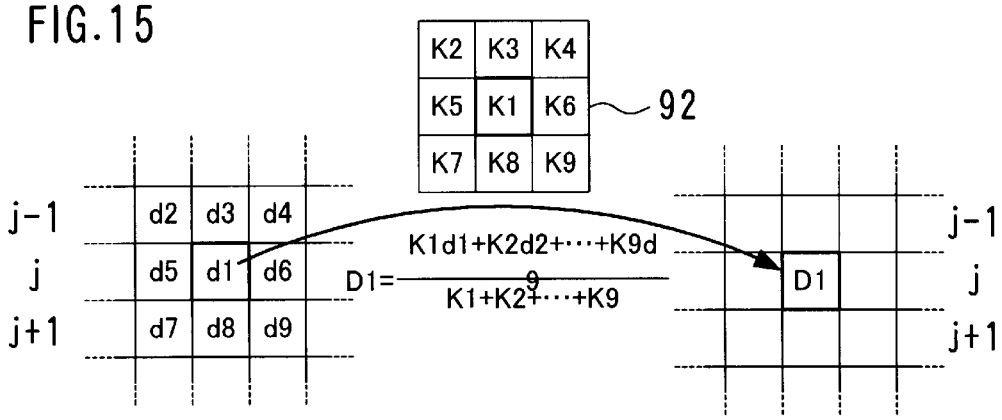
FIG. 15 shows a concept of the convolution process in a second example of the operation circuit.

FIG. 14 is a block diagram showing a second example of the data conversion circuit. FIG. 15 shows a concept of the convolution process in the second example of the operation circuit.

In a data conversion circuit 70*b* of the second example, six registers and six multipliers are added to the above-mentioned first example. In the same way as the first example, the operation between dots neighboring in the vertical direction is possible by delaying data by a line period in the memory circuit 72, and the operation between dots neighboring in the horizontal direction is possible by delaying the data by a dot period using the register in an operation circuit 73*b*. In FIG. 14, two stages of line memories and three sets of two registers connected in series are used so that the operation can be performed between input data of total nine dots, i.e., three dots in the horizontal direction and three dots in the vertical direction. A control circuit 74*b* includes a coefficient memory 743*b* that memorizes plural coefficient sets G1, G2, . . . , GN, each of which includes nine coefficients K1, K2 and K3, . . . , K9. A memory controller 742*b* reads a set of coefficients K1–K9 from the coefficient memory 743 in accordance with a combination of the output of the dot and line decision circuit 741 and the decision signal S71. The read coefficients K1–K9 are given to predetermined multipliers, respectively. At the same time, the adder 744 calculates the sum of the nine coefficients K1–K9, which is given to the divider. Though the example shown in FIG. 15 is the operation of nine dots, it is possible to adopt the operation in which the input data d2, d4, d7 and d9 and the coefficients K2, K4, K7 and K9 are not used. In this case, the capacity of the line memory, the register, the multiplier and the coefficient memory can be reduced.

According to the structure shown in FIG. 14, in the same way as the structure shown in FIG. 10, the effect of reducing the zigzag of a line display can be obtained. In addition, since the operation process in the horizontal direction can be performed, the dots at both sides of the lighted dot in the horizontal direction can be lighted in the compensation manner at any ratio. If the display line looks thick in the vertical direction, the display line can be displayed to be looked thick also in the vertical direction, so that the thickness is equalized. For example, the coefficient set (K5, K1, K6) may be set to (1, 5, 1).

Furthermore, according to the structure shown in FIG. 14, even if the input image size is different from the image size of the display panel, the input image can be adjusted to the display panel size. For example, when adjusting the image with 300 dots in the horizontal direction to the display panel of 200 dots, (0, 0, 1) and (0, 1, 1) are added to the values of the coefficient set (K5, K1, K6), and the data output is performed only in the period of the first dot and the third dot for every three dots of the input data. The input of the first dot becomes the output data without change since the coefficient is (0, 0, 1). The input of the second dot is memorized in the register without being outputted. The input of the third dot is used for the operation of the coefficient set (0, 1, 1), i.e., the average calculation with the data memorized in the register, and the result of the operation is outputted. By performing the process using three dots as a set, the number of dots in the output data is reduced to ⅔. Concerning the above-mentioned two coefficients, a value is set with the light correction process being taken in account, the process of changing the image size and the light correction process can be performed simultaneously.

Figure 16:
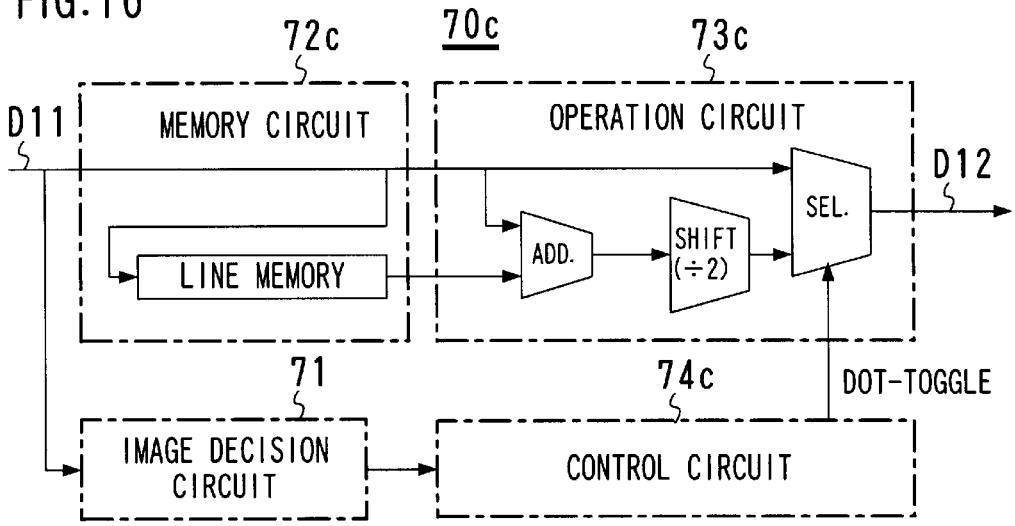
FIG. 16 is a block diagram showing a third example of the data conversion circuit.

FIG. 16 is a block diagram showing a third example of the data conversion circuit. A data conversion circuit 70*c* of the third example is simplified by eliminating one line memory and the multiplier from the structure of the above-mentioned first example. A memory circuit 72*c* consists of one line memory. An operation circuit 73*c* includes one bit shift circuit that performs division by two instead of the divider. In addition, the operation circuit 73*c* includes a selector circuit (SEL.) that selects either the data with the operation or the data without the operation and outputs the selected one. The operation of this selector circuit follows a control signal (DOT-TOGGLE) from a control circuit 74*c*. According to the data conversion circuit 70*c*, the compensation lighting can be performed for every other dot, so that the zigzag in the display of the horizontal line or the inclined line can be reduced.

Figure 17:
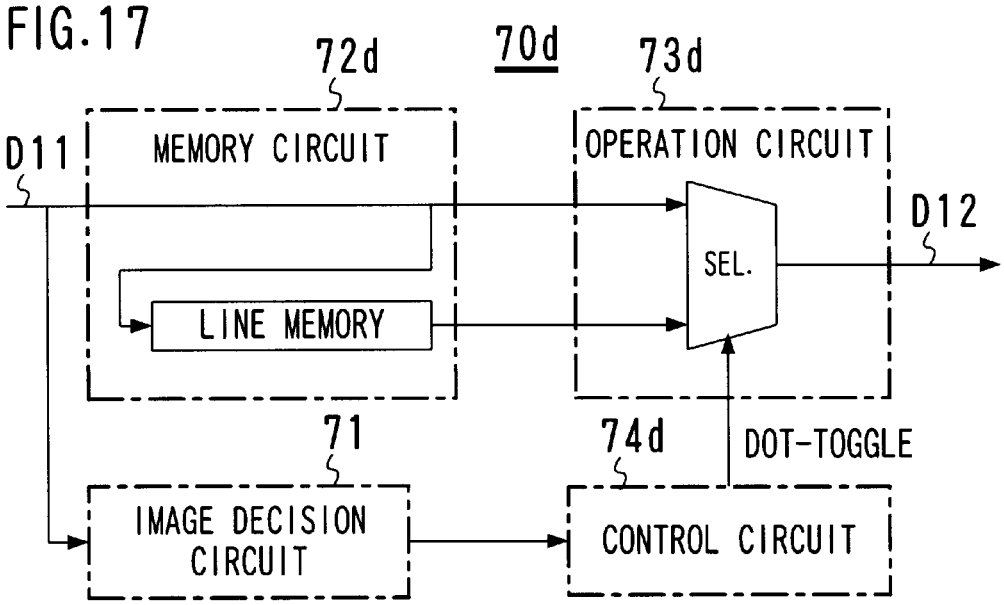
FIG. 17 is a diagram showing a fourth example of the data conversion circuit.

FIG. 17 is a diagram showing a fourth example of the data conversion circuit. In a data conversion circuit 70*d* of the fourth example, a memory circuit 72*d* consists of one line memory similarly to the third example, and an operation circuit 73*d* consists of one selector circuit (SEL.). The selector circuit selects either the data delayed by the line memory by the line period or the data without delay in accordance with the control signal (DOT-TOGGLE) from a control circuit 74*d* and outputs the selected one. According to this fourth example, a pseudo interlace conversion process that will be explained below is realized by a simple circuit.

Figure 18:
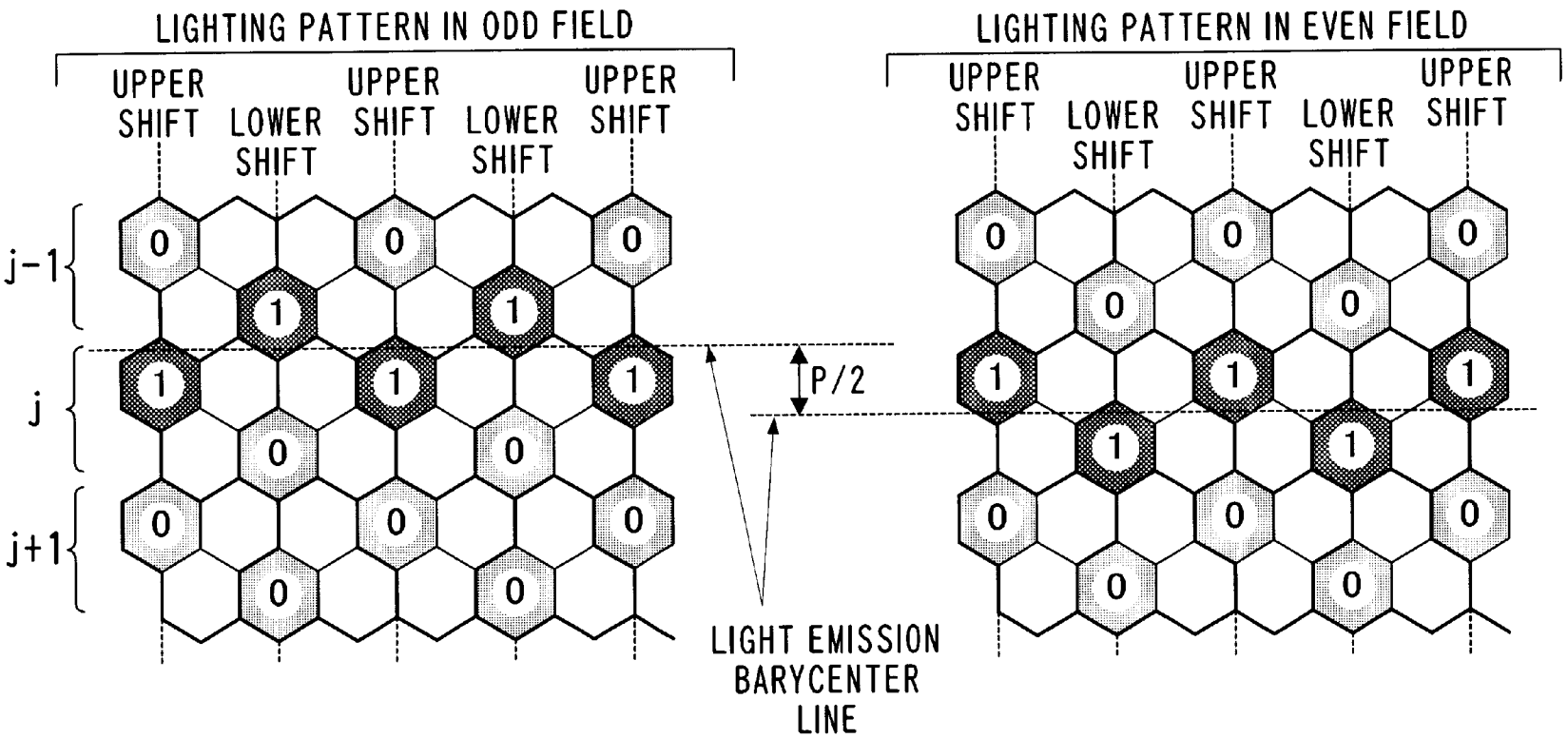
FIG. 18 is a diagram showing a lighting pattern of a single color line display by a pseudo interlace conversion process in the delta arrangement screen.

FIG. 18 is a diagram showing a lighting pattern of a single color line display by the pseudo interlace conversion process.

In the process that is explained here, image data of one frame are entered two times as an odd field and an even field. First, in the odd field, it is supposed that the data of the (j−1)th line are memorized in the line memory. In response to the input of the j-th line data, the data conversion circuit 70*d* outputs the data for the upper shift cell without delay. Concerning the lower shift cell of the next dot, the data conversion circuit 70*d* outputs the (j−1)th line data that are memorized in the line memory. The control circuit 74*d* gives the control signal (DOT-TOGGLE) to the operation circuit 73*d* for indicating output switch for each dot. In an even field, the data conversion circuit 70*d* does not perform the process substantially and outputs the input data without any change. By this operation, the lighted cell in the odd field is shifted from that in the even field in the vertical direction, so that the barycenter position of the horizontal line display is shifted by a half of the line pitch P (P/2) of the virtual screen. This means that the input image is shifted in the vertical direction by P/2, and that an interlace display is performed in which the line is shifted by a half pitch for each field. In contrast, the driving circuit 80 (see FIG. 1) performs the same operation in both the odd field and the even field. Namely, the interlace display is performed in a pseudo manner by the process of the data conversion circuit 70*d*. This pseudo interlace display can be applied to a line display with a mixed color of three colors such as a white color.

Figure 19:
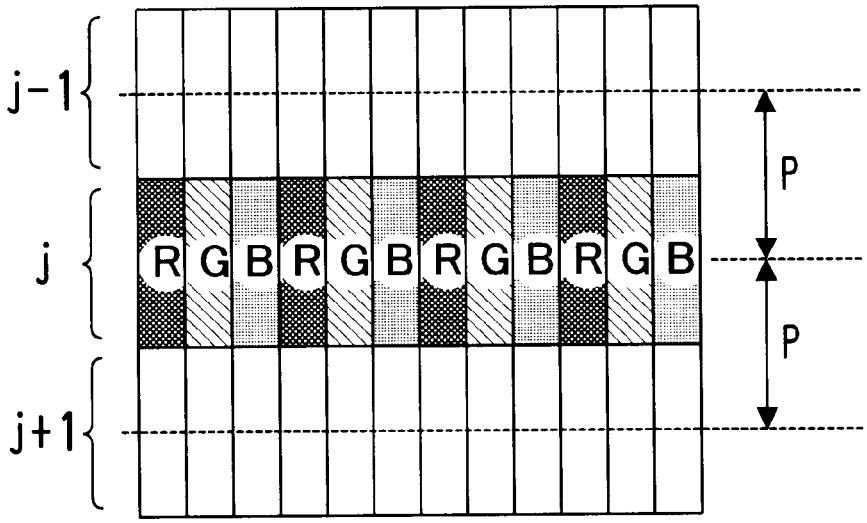
FIG. 19 is a diagram showing a lighting pattern of a three-color mix line display in the square arrangement screen.
Figure 20:
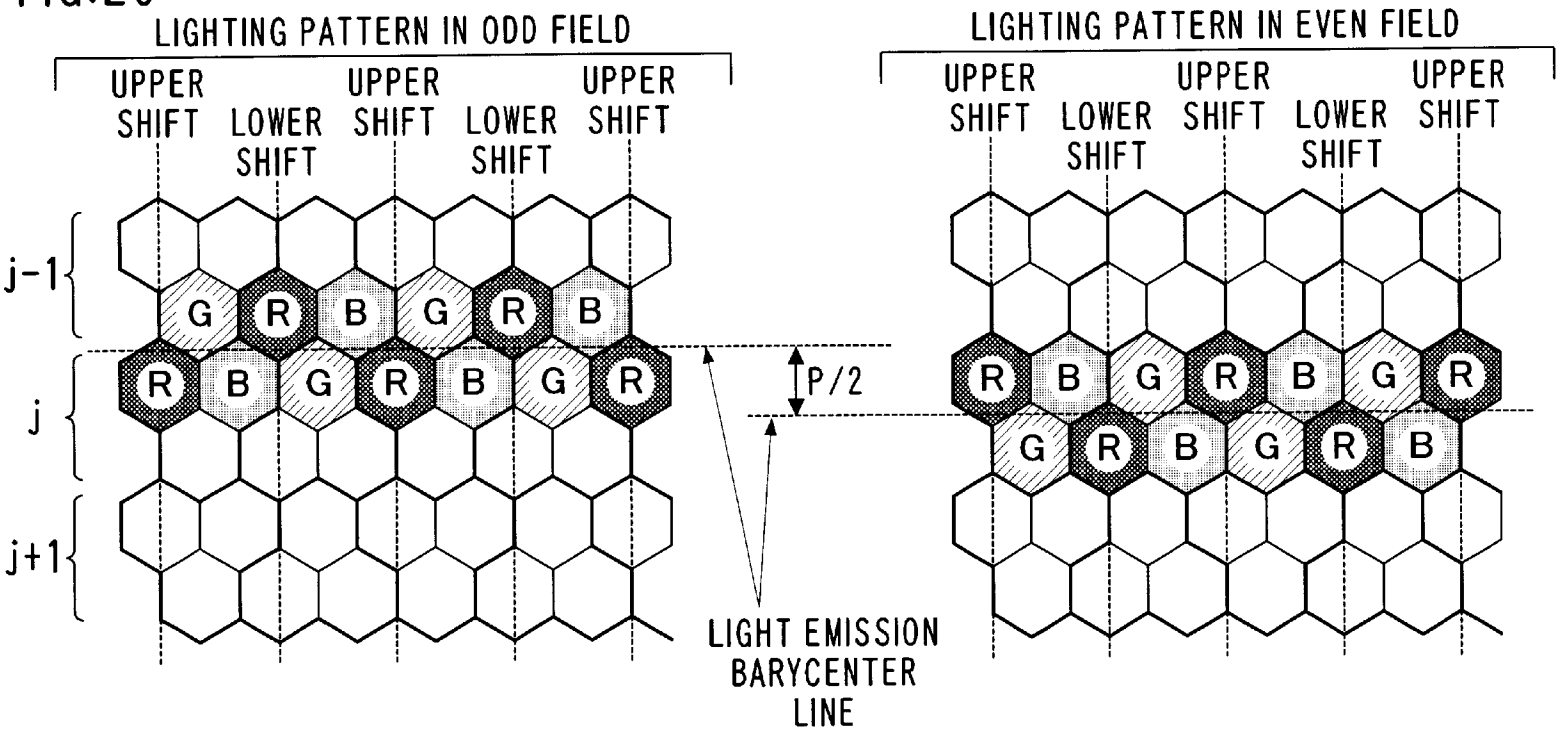
FIG. 20 is a diagram showing a lighting pattern in a color mix line display by the pseudo interlace conversion process in the delta arrangement screen.

FIG. 19 is a diagram showing a lighting pattern of a three-color mix line display in the square arrangement screen. FIG. 20 is a diagram showing a lighting pattern in a color mix line display by the pseudo interlace conversion process in the delta arrangement screen.

The data of the j-th line in the virtual input image of the square arrangement shown in FIG. 19 are displayed at the position between the (j−1)th display line and the j-th display line in the odd field period, and is displayed at the position of the j-th display line in the even field period in a delta arrangement screen as shown in FIG. 20. According to the pseudo interlace conversion process, the input image data having the line number approximately twice (more specifically, 2N−1) the line number N of PDP 1 can be displayed in the interlace manner without thinning out the line number.

The above-mentioned pseudo interlace conversion process can be embodied by adopting the circuit structure shown in FIG. 10 or 14 without limiting to the circuit shown in FIG. 17. In the circuit structure shown in FIG. 10, (0, 1, 0) and (0, 0, 1) can be used as the coefficient set (K2, K1, K3), for example. Namely, (0, 1, 0) is set to the multiplier in the odd field, and (0, 0, 1) is set to the multiplier in the even field. Similarly in the circuit shown in FIG. 14, (0, 1, 0) and (0, 0, 1) can be used as the coefficient set (K3, K1, K8), for example.

In the above-mentioned examples, since the data conversion circuits 70 and 70*b* in the first example and in the second example perform the convolution operation with weight coefficient, plural operation processes that were set individually can be composed to be performed in one operation. For example, a coefficient set can be set for combining the operation for reducing the zigzag of the line display and an edge emphasis filter operation.

According to the above-mentioned example, the process for reducing the zigzag of a line or the pseudo interlace conversion process can be switched in accordance with a type of an input image (a size, a format and information contents) and user's instruction. Thus, quality of the display image can be improved effectively.

According to the above-mentioned example, the quality of the display can be improved only by adding the data conversion circuit 70 to the conventional display device having a circuit similar to the input interface 60 and the driving circuit 80. Compared with the case of changing the structure of the conventional device, the cost increase in manufacture due to the improvement of the display performance can be minimized.

Figure 21:
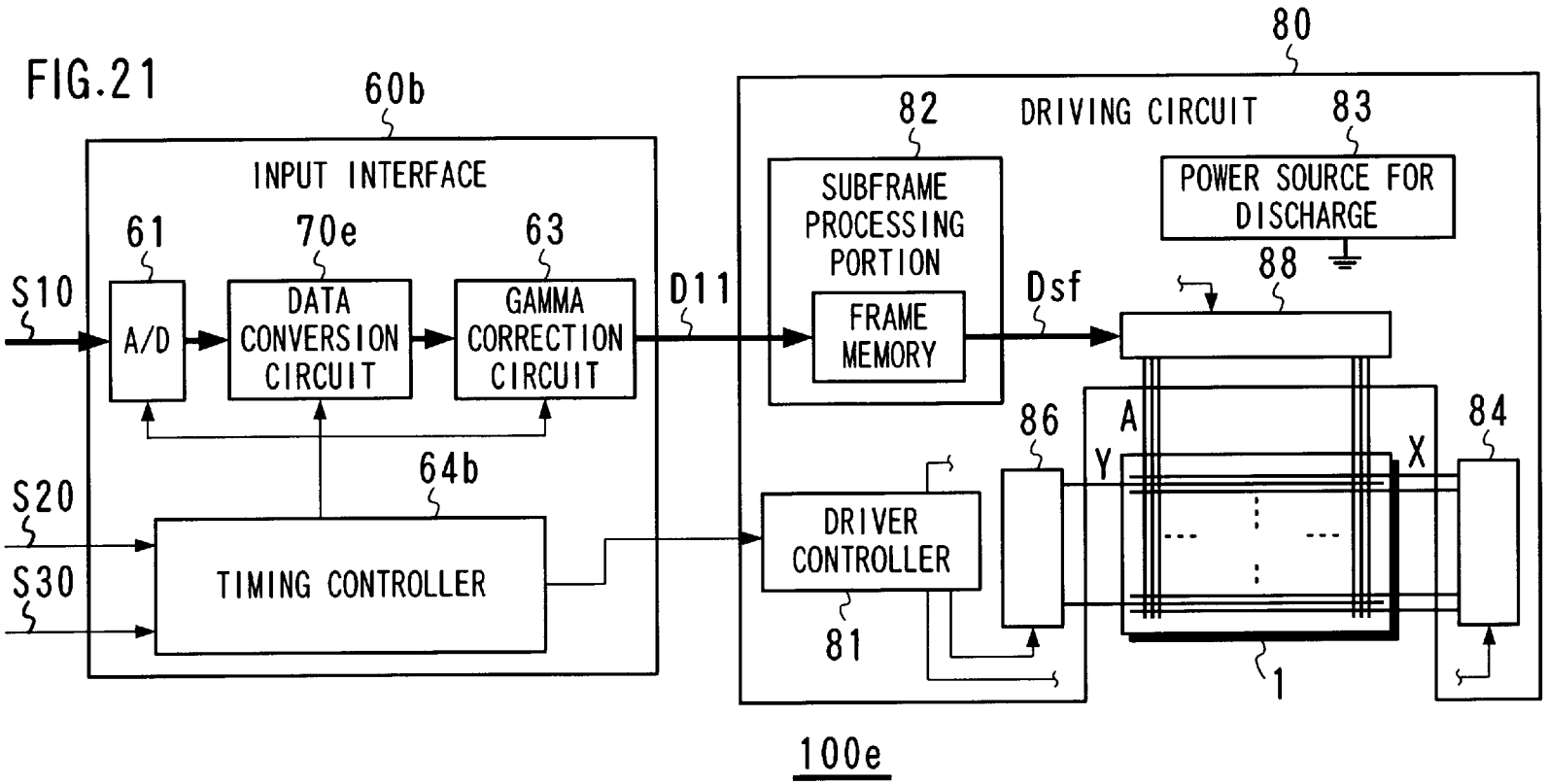
FIG. 21 shows a structure of another display device according to the present invention.

As another example of the display device, there is a structure shown in FIG. 21. In a display device 10*e*, the input interface 60*b* includes a data conversion circuit 70*e* that is unique to the present invention. When the data conversion circuit 70*e* has the line interpolation function, the number of circuit components is reduced compared with the structure shown in FIG. 1, where the interpolation circuit is provided individually. In order to perform the line interpolation in the data conversion circuit 70*e*, the contents of the coefficient memory are added, and the control timing of a timing control circuit 64*b* is changed. For example, in order to adjust input image data having 300 lines to the display screen having 200 lines, the operation circuits 73 and 73*b* shown in FIG. 10 or 14 are used, (0, 0, 1) and (0, 1, 1) are added as the values of the coefficient set (K2, K, K3), and the data output is performed only in the first line and the third line periods for every three lines of the input data. The input of the first line becomes the output data without change since the coefficient set is (0, 0, 1). The input of the second line is only written into the first line memory without being outputted. The input of the third line is used for the operation of the coefficient set (0, 1, 1), i.e., an average calculation concerning the data after passing the first line memory and the data without passing the first line memory. By performing the process by making three lines a set, the line number of the output data is reduced to ⅔. In the line interpolation, the coefficient can be set for operation of the above-mentioned compensation lighting, so that the data interpolation and the operation for the display in the delta arrangement screen can be performed simultaneously.

Figure 22:
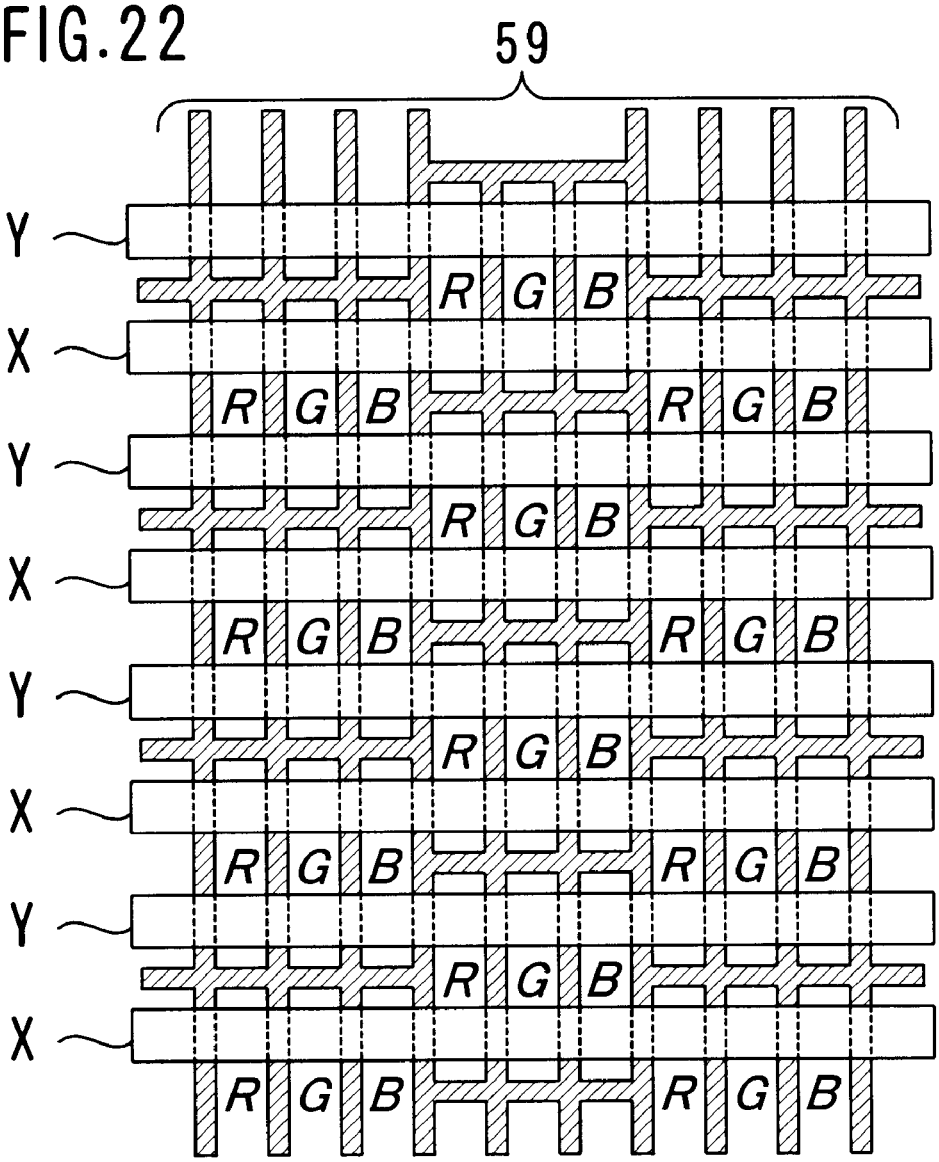
FIG. 22 shows another example of the partition pattern.

The present invention can be applied to a display device having a display screen of the delta arrangement made of a partition 59 that is a set of linear band-like wall as shown in FIG. 22, without limiting to the device having the meandering partition.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A color image display device for displaying an image that is entered in an image signal form, comprising:

a display device having an electrode matrix for display control and a cell arrangement structure in which cells aligned in one direction among cells of a color display screen has the same lighting color, and cell positions in the column direction are shifted from each other between neighboring cell columns among cell columns having the same lighting color;

an image decision circuit for deciding which of plural predetermined types an input image is;

a memory circuit for memorizing temporarily at least a part of input image data for one frame;

an operation circuit for performing an operation process having preset contents in accordance with image data for plural pixels including image data read out of the memory circuit and for outputting the process result as display data;

a driving circuit for applying a drive voltage to the electrode matrix in accordance with the display data; and an operation control circuit for switching the contents of the operation process in the operation circuit in accordance with the output of the image decision circuit.

2. A color image display device as recited in claim 1, wherein the image decision circuit performs at least either the decision whether the input image is a progressive scan image or an interlace scan image, or the decision whether the input image is a moving image or a still image.

3. A color image display device as recited in claim 1, wherein the memory circuit includes a memory for memorizing input image data for at least one line, the operation circuit includes plural multipliers for multiplying the image data by an operation coefficient, an adder for adding outputs of the multipliers and an operator for normalizing an output of the adder, and performs operation process for image data of plural pixels having position relationship neighboring in the column direction in an input image of one frame, and the operation control circuit includes a coefficient memory for memorizing plural sets of coefficients and selects a set of coefficients, which is given to the multiplier, so that the contents of the operation process in the operation circuit are switched.

4. A color image display device as recited in claim 3, wherein the set of coefficients includes three coefficients for a noted pixel and two pixels adjacent to the noted pixel in the column direction.

5. A color image display device as recited in claim 1, wherein the memory circuit includes a memory for memorizing input image data for at least one line and data delaying means for referring input image data for plural pixels on a line simultaneously, the operation circuit includes plural multipliers for multiplying the image data by an operation coefficient, an adder for adding outputs of the multipliers and an operator for normalizing an output of the adder, and performs operation process for image data of a pixel having position relationship neighboring in the column direction and a pixel having position relationship neighboring in the row direction crossing the column direction in an input image for one frame, and the operation control circuit includes a coefficient memory for memorizing plural sets of coefficients and selects a set of coefficients, which is given to the multiplier, so that the contents of the operation process in the operation circuit are switched.

6. A color image display device as recited in claim 5, wherein the set of coefficients includes five coefficients for a noted pixel and four pixels adjacent to the noted pixel at the upper, lower, left and right sides, or includes nine coefficients for a noted pixel and eight pixels surrounding the noted pixel.

7. A color image display device as recited in claim 6, wherein the display control circuit memorizes a first coefficient set including the coefficient value of one for a noted pixel and the coefficient value of zero for the other pixels, and a second coefficient set including the coefficient value of zero for a noted pixel and the coefficient value of one for the other pixels, gives the first coefficient set to the operation circuit in the operation process for the input image of one field and gives the second coefficient set to the operation circuit in the operation process for the input image of the other field when the input image is an interlace scan image.

8. A color image display device for displaying an image that is entered in an image signal form, comprising:

a display device having an electrode matrix for display control and a cell arrangement structure in which cells aligned in one direction among cells of a color display screen has the same lighting color, and cell positions in the column direction are shifted from each other between neighboring cell columns among cell columns having the same lighting color;

an image decision circuit for deciding which of plural predetermined types an input image is;

a memory circuit for memorizing temporarily at least a part of input image data for one frame;

a selection circuit for selecting either image data before being memorized in the memory circuit or image data memorized in the memory circuit and read out of the memory circuit, and outputs the selected image data as display data;

a driving circuit for applying a drive voltage to the electrode matrix in accordance with the display data; and a selection control circuit for switching the selection operation in the selection circuit in accordance with an output of the image decision circuit.

9. A color image display device as recited in claim 8, wherein the selection control circuit instructs switching of the selection operation to the selection circuit for each field and instructs switching of the selection operation to the selection circuit for each pixel in synchronization with input of the image data of each field when the input image is an interlace scan image.

* * * * *